US009476594B2

(12) United States Patent
Fockler

(10) Patent No.: US 9,476,594 B2
(45) Date of Patent: Oct. 25, 2016

(54) DOMESTIC COOKING APPLIANCE HAVING A GAS SWITCH MOUNTING SYSTEM

(71) Applicant: BSH Home Appliances Corporation, Irvine, CA (US)

(72) Inventor: Gregory Fockler, New Bern, NC (US)

(73) Assignee: BSH Home Appliances Corporation, Irvine, CA (US)

( * ) Notice: Subject to any disclaimer, the term of this patent is extended or adjusted under 35 U.S.C. 154(b) by 908 days.

(21) Appl. No.: 13/705,231

(22) Filed: Dec. 5, 2012

(65) Prior Publication Data

US 2014/0150772 A1 Jun. 5, 2014

(51) Int. Cl.
*F24C 3/12* (2006.01)

(52) U.S. Cl.
CPC ..... *F24C 3/126* (2013.01); *F24C 3/124* (2013.01)

(58) Field of Classification Search
None
See application file for complete search history.

(56) References Cited

U.S. PATENT DOCUMENTS 1,985,980 A * 1/1935 Dibble ..... F24C 3/126 126/214 A
2,069,017 A * 1/1937 Pratt ..... F24C 3/12 126/39 F
2,489,611 A * 11/1949 Becvar ..... F16K 35/14 126/39 N
3,037,596 A * 6/1962 Fordyce ..... B60R 13/0206 24/297
4,597,153 A * 7/1986 Zaydel ..... B62D 29/048 29/434
4,905,569 A * 3/1990 Seksaria ..... F41H 5/013 52/202
5,033,357 A * 7/1991 Seksaria ..... F16B 5/0233 403/167
5,851,110 A * 12/1998 Ridenour ..... F16L 19/0225 126/39 E
5,937,846 A * 8/1999 Martin ..... F23N 1/007 126/39 E
6,070,902 A * 6/2000 Kowalski ..... B60R 13/0225 280/730.2
2004/0016088 A1* 1/2004 Angellotti ..... F16B 5/065 24/297
2006/0054159 A1* 3/2006 Lin ..... F23N 1/007 126/39 N
2007/0044786 A1* 3/2007 Frost ..... F24C 3/126 126/39 N
2010/0098515 A1* 4/2010 Raymond ..... F16B 21/06 411/500
2010/0264344 A1* 10/2010 Shaffer ..... F24C 3/124 251/213
2011/0210223 A1* 9/2011 Nishiro ..... F16B 19/1081 248/316.1
2011/0277742 A1* 11/2011 Freeman ..... F24C 3/12 126/39 N

* cited by examiner

*Primary Examiner* — Gregory Huson
*Assistant Examiner* — Martha Becton
(74) *Attorney, Agent, or Firm* — Michael E. Tschupp; Andre Pallapies

(57) ABSTRACT

A domestic cooking appliance having a gas burner and a control panel assembly is provided. The assembly includes a control panel cover having an alignment pin and an opening; a gas switch having a protruding portion that extends through the opening in the control panel cover when the control panel assembly is in an assembled position; a gas manifold for delivering gas to the gas switch, the gas switch being positionally fixed relative to the gas manifold; a mounting bracket positionally fixed relative to the gas manifold, the mounting bracket having a mounting portion attached to the appliance, a positioning surface that supports the control panel cover, and a hole in the positioning surface that receives the alignment pin. The hole is positionally fixed relative to the protruding portion of the gas switch when the control panel assembly is in the assembled position.

20 Claims, 5 Drawing Sheets

DOMESTIC COOKING APPLIANCE HAVING A GAS SWITCH MOUNTING SYSTEM

FIELD OF THE INVENTION

The invention is directed to a domestic cooking appliance having a mounting system for gas switches on the domestic cooking appliance.

An example of an application for the invention is a domestic cooktop or a domestic range having a mounting arrangement for the gas flow control switches on the domestic cooktop or domestic range.

BACKGROUND OF THE INVENTION

Some domestic cooking appliances have a control panel, usually at the front of the appliance, that includes one or more displays and one or more control knobs. Examples of such domestic cooking appliances include cooktops and ranges, or ovens. In the case of domestic cooking appliances that use a gas as the fuel for heating, rotary control knobs are usually used to control the amount of gas that is fed to a burner and, as a result, the amount of heat produced by the burner. These control knobs are usually attached to a rotating shaft that is part of a gas switch or gas valve located behind a decorative control panel cover.

The decorative control panel cover can include markings or other indicia that must align precisely with the control knob in order to provide a quality appearance. This precise alignment can be difficult and expensive to achieve due to the manual labor needed to adjust the positions of the multiple gas switches. This procedure often includes trial and error adjustment involving loosening and tightening screws.

In light of the above, there is a need for a system that quickly, easily, and precisely locates a control panel or control panel cover relative to a plurality of gas switches located behind the control panel or control panel cover.

SUMMARY

The invention achieves the benefit of providing a simple and cost effective system for precisely locating a control panel or control panel cover relative to a plurality of gas switches located behind the control panel or control panel cover. In this description, the terms "control panel cover" and "control panel" are used interchangeably to indicate either a control panel or a control panel cover. The use of either one of the terms is understood to mean both situations.

Particular embodiments of the invention are directed to a domestic cooking appliance. The domestic cooking appliance includes a gas burner; and a control panel assembly. The control panel assembly has a control panel cover having a first alignment pin and an opening; a first gas switch that regulates an amount of gas delivered to the gas burner of the domestic cooking appliance, the first gas switch having a protruding portion that extends through the opening in the control panel cover when the control panel assembly is in an assembled position; a gas delivery manifold for delivering gas to the first gas switch, the first gas switch being fixed to the gas delivery manifold and positionally fixed relative to the gas delivery manifold; a first mounting bracket fixed to the gas delivery manifold and positionally fixed relative to the gas delivery manifold, the first mounting bracket having a mounting portion attached to the domestic cooking appliance, a positioning surface that supports the control panel cover, and a hole in the positioning surface that receives the first alignment pin. The hole is positionally fixed relative to the protruding portion of the first gas switch when the control panel assembly is in the assembled position. In this manner the invention accurately aligns the gas switches with the control panel cover.

Other embodiments of the invention are directed to a control panel assembly for a gas domestic cooking appliance having a gas burner. The assembly includes a control panel cover having a first alignment pin and an opening; a first gas switch for regulating an amount of gas delivered to the gas burner of the domestic cooking appliance, the first gas switch having a protruding portion that extends through the opening in the control panel cover when the control panel assembly is in an assembled position; a gas delivery manifold for delivering gas to the first gas switch, the first gas switch being fixed to the gas delivery manifold and positionally fixed relative to the gas delivery manifold; a first mounting bracket fixed to the gas delivery manifold and positionally fixed relative to the gas delivery manifold, the first mounting bracket having a mounting portion configured to attach to the domestic cooking appliance, a positioning surface that supports the control panel cover, and a hole in the positioning surface that receives the first alignment pin. The hole is positionally fixed relative to the protruding portion of the first gas switch when the control panel assembly is in the assembled position. In this manner the invention accurately aligns the gas switches with the control panel cover.

BRIEF DESCRIPTION OF THE DRAWINGS

The following figures form part of the present specification and are included to further demonstrate certain aspects of the disclosed features and functions, and should not be used to limit or define the disclosed features and functions. Consequently, a more complete understanding of the exemplary embodiments and further features and advantages thereof may be acquired by referring to the following description taken in conjunction with the accompanying drawings, wherein.

DETAILED DESCRIPTION

The invention is described herein with reference to the accompanying drawings in which exemplary embodiments of the invention are shown. The invention may, however, be embodied in many different forms and should not be construed as limited to the embodiments set forth herein.

Some domestic kitchens include a cooktop or range having gas burners for use in heating food in pans or other containers. Gas flow to the burners can be controlled by gas switches that include a valve controlled by a rotating knob shaft. These types of controls often protrude through a control panel cover and have attached to them a knob that is turned by a user to set the desired flow rate of the gas, which, in turn, determines the height of the flame used for heating.

Figure 1:
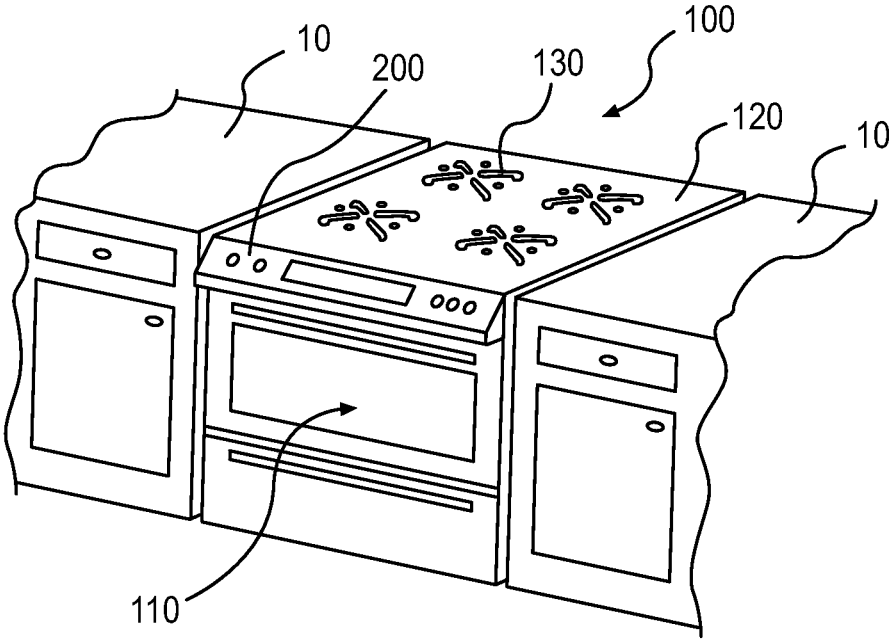
FIG. 1 is a perspective view of an example of a domestic cooking appliance in accordance with exemplary embodiments of the invention.

FIG. 1 shows an example of a range 100 that has a cooktop 120 including, in this case, four burners 130. Range 100 also has a door 110 that allows access to an oven area. In this example, range 100 is located between two cabinets 10, but other types of installations exist, such as, for example, a cooktop built into a countertop with no oven below it. The exemplary range 100 shown in FIG. 1 has a control panel cover 200 that includes various displays and controls to be used by a user of the range.

Figure 2:
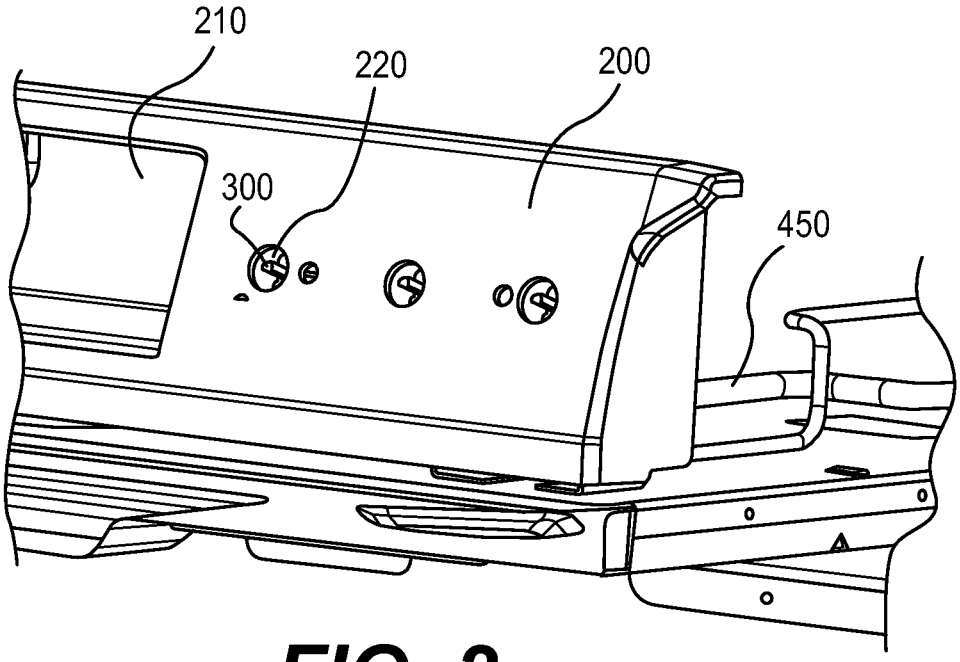
FIG. 2 is a partial perspective view of an example of a cooking appliance in accordance with exemplary embodiments of the invention.

FIG. 2 shows a partial view of control panel cover 200 with parts of the cooktop and range removed. As shown in FIG. 2, control panel cover 200 has an opening 210 through which a display can be seen. The display can show various information including, for example, temperature, time, and other information. Control panel cover 200 also has, in this example, three holes 220 through which the knob shafts of gas switches 300 protrude. Also shown in FIG. 2 is a gas line 450 that supplies gas to a gas manifold (described below) that in turn supplies the gas to gas switches 300.

Figure 3:
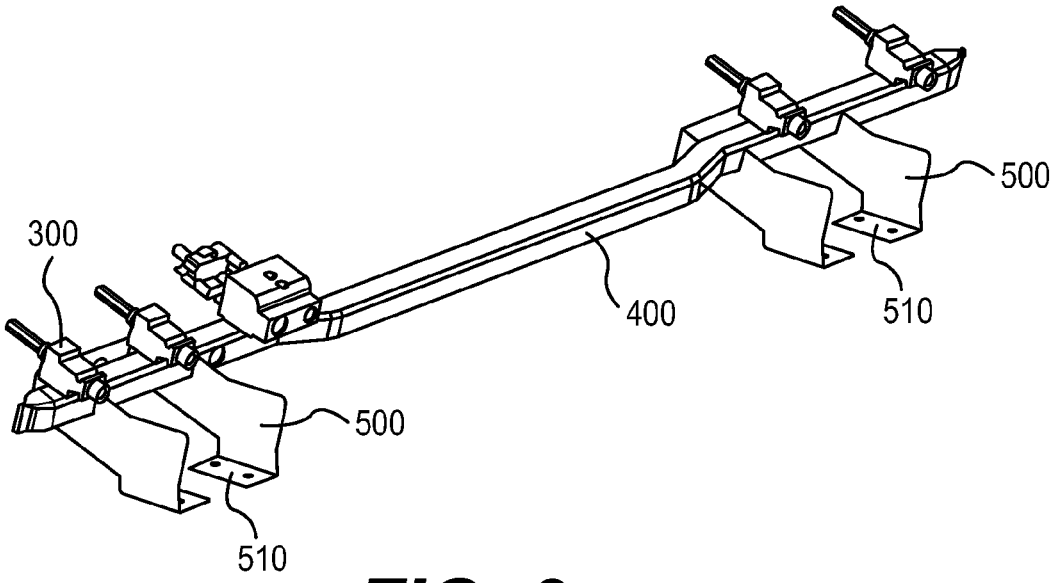
FIG. 3 is a perspective view of an example of a gas switch and manifold system in accordance with exemplary embodiments of the invention.
Figure 4:
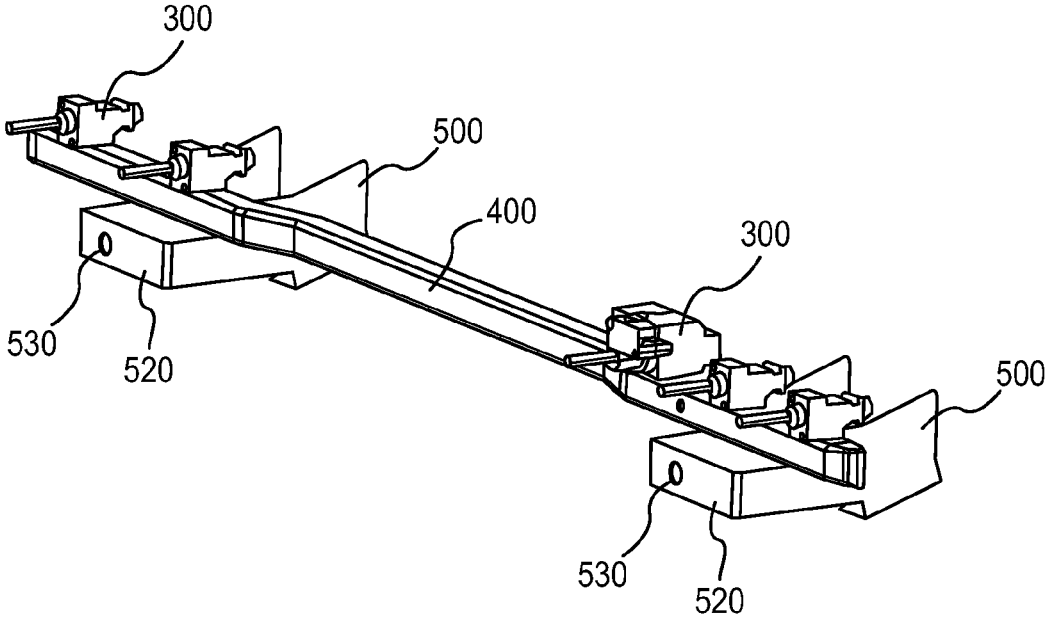
FIG. 4 is a perspective view of an example of a gas switch and manifold system in accordance with exemplary embodiments of the invention.

FIGS. 3 and 4 show an example of a gas supply system in accordance with embodiments of the invention. A gas manifold 400 has rigidly mounted to it five gas switches 300. Gas switches 300 are mounted to gas manifold 400 in a fixed manner so that they cannot move relative to gas manifold 400. Two mounting brackets 500 are shown attached to gas manifold 400. Mounting brackets 500 are attached to gas manifold 400 in a fixed manner so that they cannot move relative to gas manifold 400. Mounting brackets 500 each include, in this example, two mounting portions 510 that are used to fix the assembly to the cooktop or range. As a result of the fixed nature of the connections between gas switches 300, gas manifold 400, and mounting brackets 500, the positional relationship between the rotary knob shafts of gas switches 300 and attachment portions 510 of mounting brackets 500 is fixed and cannot be changed.

Each mounting bracket 500 includes a positioning surface 520 that has a hole 530. As will be described below, hole 530 receives an alignment pin that is part of control panel cover 200.

The design of mounting bracket 500 minimizes tolerance stack up by avoiding influence of normal bend tolerances. In some conventional control panels, the mounting systems include multiple bent brackets that often position the gas switches separately from the control panel cover. These separate mounting systems, and especially the compounding of tolerances associated with multiple bends, can introduce unacceptable error in the relative positions of the knob shafts and the holes. This can result in misalignment of the knobs relative to printed graphics or other markings on the control panel cover. The simple design of mounting brackets 500 avoids this problem.

Figure 5:
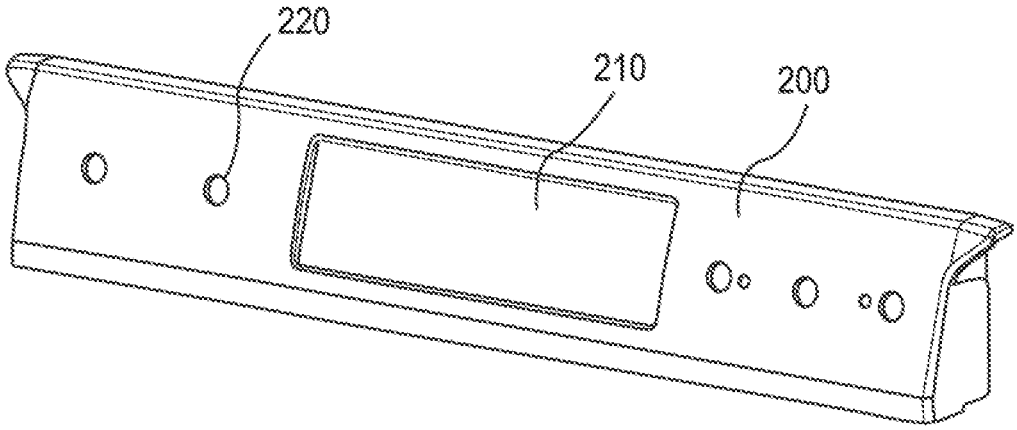
FIG. 5 is a perspective view of an example of a control panel cover in accordance with exemplary embodiments of the invention.
Figure 6:
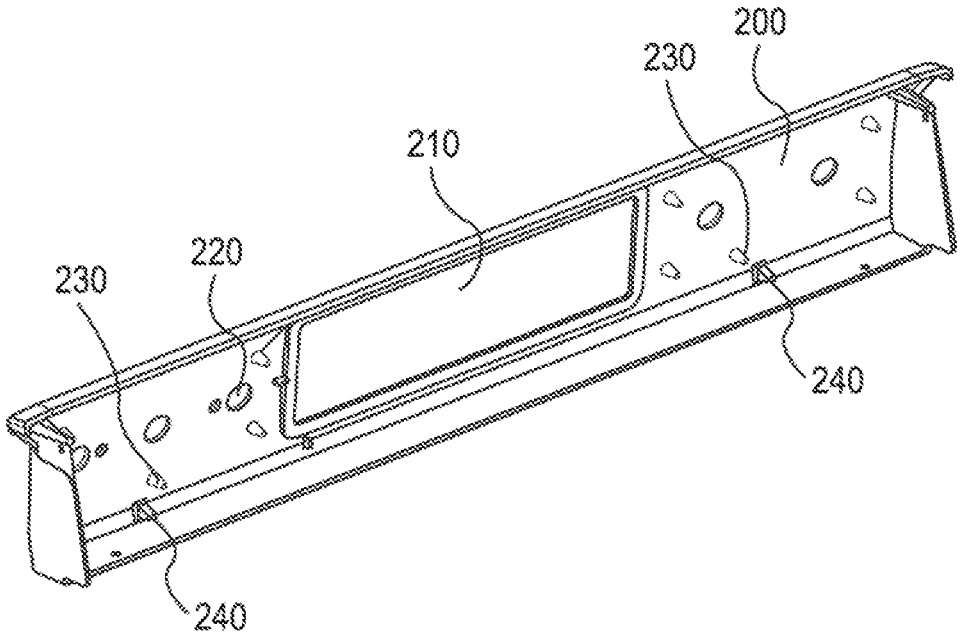
FIG. 6 is a perspective view of an example of a control panel cover in accordance with exemplary embodiments of the invention.

FIGS. 5 and 6 show an example of control panel cover 200 that has five holes 220. However, fewer or more holes 220 can be provided depending on how many gas switches are required by the cooktop or range. FIG. 6 shows a backside view of control panel cover 220 and shows two alignment pins 230 that are used to align control panel cover 200 relative to mounting brackets 500 and, as a result, gas switches 300. Alignment pins 230 are shown as conical in FIG. 6. A conical configuration of alignment pins 230 assists in the assembly of control panel cover 200 to mounting brackets 500. Also shown in FIG. 6 are two lift fingers 240 that assist in the proper positioning of control panel cover 200 when it is installed on mounting brackets 500.

Figure 7:
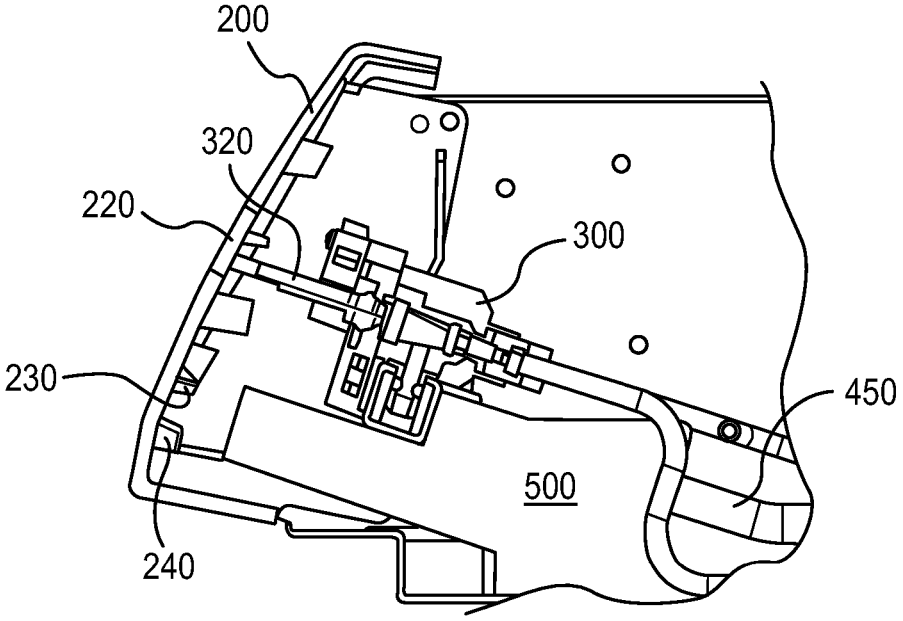
FIG. 7 is a partial side sectional view of an exemplary embodiment of the invention during assembly.
Figure 8:
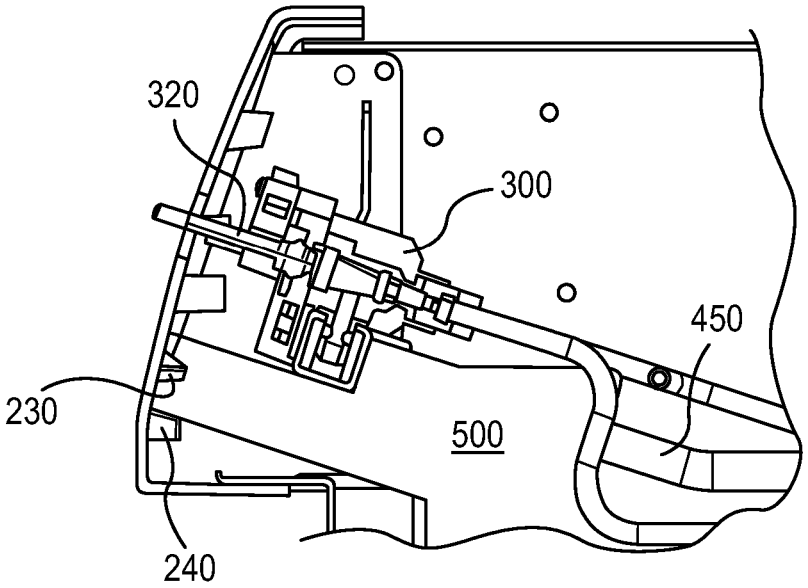
FIG. 8 is a partial side sectional view of an exemplary embodiment of the invention after assembly.

FIGS. 7 and 8 are sectional side views of control panel cover 200 and the gas switch/gas manifold/mounting bracket assembly. FIG. 7 shows control panel cover 200 being rotated into position during assembly of the unit. In this position, the rotating knob shaft 320 of each gas switch 300 is just beginning to enter one of the holes 220 as an upper trim piece of control panel cover 200 slides over a thin sheet-type element of the cooktop. Also in this position, alignment pin 230 has not yet engaged hole 530 in mounting bracket 500. Further rotation of control panel cover 200 results in the final assembled position as shown in FIG. 8. As this rotation takes place, the bottom edge of positioning surface 520 of mounting bracket 500 rides along the top of lifting finger 240 to guide alignment pin 230 into hole 530.

FIG. 8 shows control panel cover 200 in the final assembled position. In this position, each alignment pin 230 extends through hole 530 in one of the mounting brackets 500. Also, the bottom edge of positioning surface 520 may, or may not, rest on lifting finger 240. Lifting finger 240 is merely to help guide alignment pin 230 into hole 530 and is not necessarily a part of the final alignment engagement. The precise alignment of control panel cover 200 relative to mounting brackets 500 and, thus, knob shafts 320, is determined by alignment pins 230 fully engaging holes 530.

Figure 9:
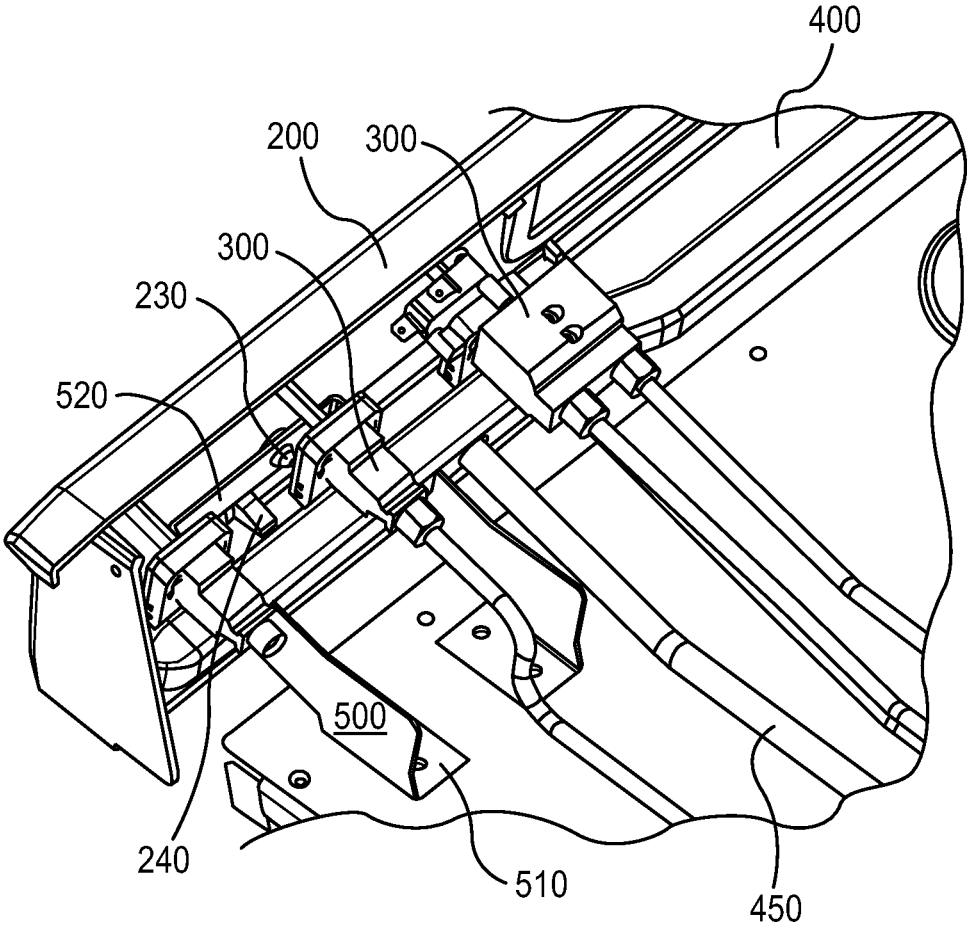
FIG. 9 is a partial perspective view of an exemplary embodiment of the invention after assembly.

FIG. 9 shows control panel cover 200 and the other elements in their final positions. Because gas switches 300 are fixed relative to gas manifold 400 which, in turn, is fixed relative to mounting brackets 500 and because control panel cover 200 is precisely positioned relative to mounting brackets 500, perfect alignment of knob shafts 320 in holes 220 is achieved. As explained above, this avoids any need for individual adjustment of gas switches 300 to center them within holes 230.

Although the embodiments shown in FIGS. 7-9 include lifting fingers and assemble with a tilting action, other embodiments assemble with a linear motion. Some of these embodiments do not include lifting fingers. In some of these embodiments (and other embodiments), positioning surface 520 of mounting bracket 500 can be sloped as shown in the Figures, or can be vertical.

It will be appreciated that variants of the above-disclosed and other features and functions, or alternatives thereof, may be combined into many other different systems or applications. Various presently unforeseen or unanticipated alternatives, modifications, variations or improvements therein may be subsequently made by those skilled in the art which are also intended to be encompassed by the invention.

What is claimed is:

1. A domestic cooking appliance, comprising:

a gas burner; and a control panel assembly having a control panel cover having an outermost surface that is visible to a user when in use, a backside that is opposite the outermost surface, a first alignment pin and an opening in the outermost surface;

a first gas switch that regulates an amount of gas delivered to the gas burner of the domestic cooking appliance, the first gas switch having a protruding portion that extends through the opening in the control panel cover when the control panel assembly is in an assembled position;

a gas delivery manifold for delivering gas to the first gas switch, the first gas switch being fixed to the gas delivery manifold and positionally fixed relative to the gas delivery manifold;

a first mounting bracket fixed to the gas delivery manifold and positionally fixed relative to the gas delivery manifold, the first mounting bracket having a mounting portion attached to the domestic cooking appliance, a positioning surface that contacts the backside of the control panel cover and supports the control panel cover, and a hole in the positioning surface that receives the first alignment pin;

wherein the hole is positionally fixed relative to the protruding portion of the first gas switch when the control panel assembly is in the assembled position when in use.

2. The domestic cooking appliance of claim 1, wherein the protruding portion is a rotary shaft of the first gas switch.

3. The domestic cooking appliance of claim 2, wherein the first gas switch is a gas valve.

4. The domestic cooking appliance of claim 1, wherein the control panel cover further comprises a first lifting finger that, during assembly, engages the first mounting bracket and guides the control panel cover relative to the positioning surface of the first mounting bracket so that the first alignment pin aligns with the hole.

5. The domestic cooking appliance of claim 1, further comprising a second alignment pin on the control panel cover; and a second mounting bracket, the second mounting bracket being fixed to the gas delivery manifold and positionally fixed relative to the gas delivery manifold, the second mounting bracket having a mounting portion attached to the domestic cooking appliance, a positioning surface that supports the control panel cover, and a hole in the positioning surface that receives the second alignment pin.

6. The domestic cooking appliance of claim 5, further comprising a second gas switch for regulating an amount of gas delivered to a second gas burner of the domestic cooking appliance, the second gas switch having a protruding portion that extends through a second opening in the control panel cover when the control panel assembly is in the assembled position, wherein the protruding portion of the first gas switch is a rotary shaft of the first gas switch, and the first gas switch is a gas valve, and the protruding portion of the second gas switch is a rotary shaft of the second gas switch, and the second gas switch is a gas valve.

7. The domestic cooking appliance of claim 6, wherein the first and second alignment pins are conical in shape.

8. The domestic cooking appliance of claim 7, wherein the control panel cover further comprises a first lifting finger that, during assembly, engages the first mounting bracket and guides the control panel cover relative to the positioning surface of the first mounting bracket so that the first alignment pin aligns with the hole in the first mounting bracket, and the control panel cover further comprises a second lifting finger that, during assembly, engages the second mounting bracket and guides the control panel cover relative to the positioning surface of the second mounting bracket so that the second alignment pin aligns with the hole in the second mounting bracket.

9. The domestic cooking appliance of claim 5, wherein the first and second alignment pins are conical in shape.

10. A control panel assembly for a gas domestic cooking appliance having a gas burner, the assembly comprising:

a control panel cover having an outermost surface that is visible to a user when in use, a backside that is opposite the outermost surface, a first alignment pin and an opening in the outermost surface;

a first gas switch for regulating an amount of gas delivered to the gas burner of the domestic cooking appliance, the first gas switch having a protruding portion that extends through the opening in the control panel cover when the control panel assembly is in an assembled position;

a gas delivery manifold for delivering gas to the first gas switch, the first gas switch being fixed to the gas delivery manifold and positionally fixed relative to the gas delivery manifold;

a first mounting bracket fixed to the gas delivery manifold and positionally fixed relative to the gas delivery manifold, the first mounting bracket having a mounting portion configured to attach to the domestic cooking appliance, a positioning surface that contacts the backside of the control panel cover and supports the control panel cover, and a hole in the positioning surface that receives the first alignment pin;

wherein the hole is positionally fixed relative to the protruding portion of the first gas switch when the control panel assembly is in the assembled position when in use.

11. The assembly of claim 10, wherein the protruding portion is a rotary shaft of the first gas switch.

12. The assembly of claim 11, wherein the first gas switch is a gas valve.

13. The assembly of claim 10, wherein the control panel cover further comprises a first lifting finger that, during assembly, engages the first mounting bracket and guides the control panel cover relative to the positioning surface of the first mounting bracket so that the first alignment pin aligns with the hole.

14. The assembly of claim 10, further comprising a second alignment pin on the control panel cover; and a second mounting bracket, the second mounting bracket being fixed to the gas delivery manifold and positionally fixed relative to the gas delivery manifold, the second mounting bracket having a mounting portion configured to attach to the domestic cooking appliance, a positioning surface that supports the control panel cover, and a hole in the positioning surface that receives the second alignment pin.

15. The assembly of claim 14, further comprising a second gas switch for regulating an amount of gas delivered to a second gas burner of the domestic cooking appliance, the second gas switch having a protruding portion that extends through a second opening in the control panel cover when the control panel assembly is in the assembled position, wherein the protruding portion of the first gas switch is a rotary shaft of the first gas switch, and the first gas switch is a gas valve, and the protruding portion of the second gas switch is a rotary shaft of the second gas switch, and the second gas switch is a gas valve.

16. The assembly of claim 15, wherein the first and second alignment pins are conical in shape.

17. The assembly of claim 16, wherein the control panel cover further comprises a first lifting finger that, during assembly, engages the first mounting bracket and guides the control panel cover relative to the positioning surface of the first mounting bracket so that the first alignment pin aligns with the hole in the first mounting bracket, and the control panel cover further comprises a second lifting finger that, during assembly, engages the second mounting bracket and guides the control panel cover relative to the positioning surface of the second mounting bracket so that the second alignment pin aligns with the hole in the second mounting bracket.

18. The assembly of claim 14, wherein the first and second alignment pins are conical in shape.

19. The assembly of claim 10, wherein the mounting portion is configured to attach directly to the domestic cooking appliance.

20. The domestic cooking appliance of claim 1, wherein the mounting portion is attached directly to the domestic cooking appliance.

* * * * *